United States Patent [19]

Montilla, Jr. et al.

[11] 4,421,374

[45] Dec. 20, 1983

[54] TRIFURCATED INSULATION-PENETRATING TERMINAL

[75] Inventors: Lino M. Montilla, Jr.; Alexander Uchuck, both of Baltimore, Md.

[73] Assignee: Western Electric Company, Inc., New York, N.Y.

[21] Appl. No.: 184,565

[22] Filed: Sep. 5, 1980

[51] Int. Cl.[3] ..... H01R 11/20

[52] U.S. Cl. ..... 339/97 P

[58] Field of Search ..... 339/97 R, 97 P, 98

[56] References Cited

U.S. PATENT DOCUMENTS

| | | | |
|---|---|---|---|
| 2,694,189 | 11/1954 | Wirsching | 339/97 R |
| 3,027,536 | 3/1962 | Pasternak | 339/97 R |
| 3,112,147 | 11/1963 | Pferd et al. | 339/97 |
| 3,234,498 | 2/1966 | Logan | 339/97 |
| 3,394,454 | 7/1968 | Logan | 29/629 |
| 3,604,071 | 9/1971 | Sedlacek | 339/97 P |
| 3,761,866 | 9/1973 | Sedlacek | 339/97 R |
| 3,836,942 | 9/1974 | Knickerbocker | 339/97 R |
| 4,002,391 | 1/1977 | Dunn | 339/98 |
| 4,084,877 | 4/1978 | Knickerbocker | 339/97 P |
| 4,085,994 | 4/1978 | Volinskie | 339/97 R X |
| 4,106,837 | 8/1978 | Paluch | 339/98 |
| 4,150,867 | 4/1979 | Knickerbocker | 339/97 P |
| 4,169,646 | 10/1979 | Stape et al. | 339/97 R |
| 4,350,405 | 9/1982 | Yapoudjian | 339/97 P |

FOREIGN PATENT DOCUMENTS

| | | | |
|---|---|---|---|
| 1276449 | 6/1972 | United Kingdom | 339/98 |

*Primary Examiner*—E. R. Kazenske
*Assistant Examiner*—John S. Brown
*Attorney, Agent, or Firm*—E. W. Somers

[57] ABSTRACT

A trifurcated terminal (10) which is mounted in an aperture (52) in a plastic terminal block (51) is made from flat metallic material and includes a base having a center beam and two lateral beams (18–18) extending therefrom. Portions of the beams define conductor-receiving slots (31–31) having entries (23–23) which establish electrical engagement with insulated conductors (11–11). The center beam includes a locking element (71) which protrudes from one side thereof and which is received in a recess (72) that communicates with the aperture in the plastic block to support the center beam against substantial deflection during insertion of the conductors in either slot. This arrangement permits the beams to be proportioned to engage and retain the conductors without damaging them while having widths which do not cumulatively exceed the width of priorly used terminals in order to preserve the density of a plurality of terminals in a predetermined geometrical arrangement in the terminal block.

12 Claims, 11 Drawing Figures

PRIOR ART

TRIFURCATED INSULATION-PENETRATING TERMINAL

TECHNICAL FIELD

This invention relates to a trifurcated insulation-penetrating terminal and, more particularly, to a connector having a metallic trifurcated terminal which is mounted in an aperture in a plastic block with a center furcation of each terminal being substantially restrained against movement during the insertion of insulated conductors into conductor-receiving slots formed between the center furcation and lateral furcations of the terminal.

BACKGROUND OF THE INVENTION

A well known clip-type terminal includes a flat piece of metal having an integrally formed, resilient, bifurcated portion providing one or more conductor-receiving slots. An insulated conductor is forced into the slot which is formed between opposing faces of the furcations or beams as they are often called and which is of a width that is considerably less that the diameter of the conductive element of the insulated conductor. See U.S. Pat. No. 3,112,147 which issued on Nov. 26, 1963 in the names of W. Pferd et al.

The insertion of the conductor into the slot results in a penetration of the insulation so that electrical contact is achieved between the conductor and the surfaces that define the slot. In some kinds of these terminals, the penetration is achieved by the insulation being crushed, while in others, it is achieved by the insulation being sliced by specially formed entrance portions of the slots.

Typically, a plurality of these terminals are mounted in apertures in a plastic block to form a connector. See, for example, U.S. Pat. No. 3,234,498 which issued on Feb. 8, 1966 in the name of A. Logan. Such a terminal block and slotted insulation penetrating terminals are also shown in U.S. Pat. No. 3,836,942, for example. For use in some equipment, the terminals are formed with wire-wrapping tangs which depend from a lower surface of the block to facilitate the connection of additional conductors.

Some applications of these kinds of connectors require that more than one conductor be connected to the same terminal. In prior art terminals of this type which are adapted to receive more than one conductor, a bifurcated portion generally has been provided for each conductor with all pairs of furcations depending from a single strip of metal. Prior art connectors of this type include those in which two single slot terminals are overlapped with the overlapping portions being welded together.

In the use of multi-conductor clip terminals, the most common demand is for a two conductor terminal. Considerable space could be saved if a two conductor terminal could be made with three furcations or beams-one center and two side—thereby providing two slots with the middle beam being common to both slots. Such a terminal is shown in U.S. Pat. No. 3,605,071.

Besides the accommodation of plural conductors, the insertion of the conductors into the slots between the beams presents a problem. The construction of slotted insulation-penetrating terminals is such that considerable force is required to insert a conductor into one of its slots, with the result that a special insertion tool is usually provided. The tool has end surfaces which engage the insulated conductor at a point immediately adjacent to the side surfaces of the beams so that the conductor can be forced into the slot, thus spreading the beams. In the single conductor slotted terminal, it has been found that both beams are flexed an equal amount.

The characteristic of a slotted beam type terminal, whether of the insulation crushing type or the insulation slicing type, is that the contact force developed by the beams must be sufficient to effect the desired crushing or slicing of the insulation, but at the same time, not so great as to pinch off the conductor or to materially weaken the same by nicking. It is also desirable to design a terminal so that it will accommodate several conductor gauge sizes. With the larger size conductor, there is a greater deflection of the beams, and therefore a greater force is exerted on the conductor. This in itself is not particularly objectionable since the larger diameter conductors are better able to resist the pinching-off effect, but this tends to limit the ability of the terminal to accommodate a plurality of adjacent gauge size conductors.

In a two slot terminal having a common center beam and two lateral beams, both lateral beams react against the insertion of a first conductor. Thus, the insertion of the second conductor ordinarily requires a relatively greater force than that for the insertion of the first conductor due to the fact that one lateral beam is already stressed to an extent corresponding to its deflection. Therefore, the force ordinarily exerted by the clip beams on the second conductor might be sufficiently great to pinch off the conductive element of the conductor. In other words, the range of forces encountered in prior art two conductor, clip-type terminals is greater than those encountered in the design for a single conductor clip type terminal.

The clip type terminal of the above-identified U.S. Pat. No. 3,605,071 relies on relative stiffnesses as between the center beam and the two outer beams to avoid damage to the conductors while providing a trifurcated terminal. This arrangement attempts to restrict deflection of the outer beam particularly since the terminal establishes electrical engagement with an insulated conductor by crushing the insulation.

Arrangements for mounting a plurality of clip-type terminals in a molded plastic terminal block such as those shown in U.S. Pat. No. 3,394,454 and in U.S. Pat. No. 4,084,877 are well known. For example, in one mounting arrangement, each terminal is formed with a shoulder having an opening therein. When a terminal of this type is inserted into an aperture in a block, a protuberance in the aperture is depressed by a lower part of the shoulder. After the terminal passes a narrow part of the aperture, the protuberance returns to its original configuration and protrudes into the aperture thereby locking the terminal in the block.

Another problem in these kinds of arrangements relates to the density of the terminals in the block. Blocks which have been made available with the welded, overlapping terminal arrangement described hereinbefore have a relatively high density. It is desirable to be able to maintain that density without the necessity of welding together terminals and yet have a terminal which is capable of establishing electrical contact with a conductor without damaging the conductor. This presents a problem in that the furcations of the terminal must, within dimensional constraints, be capable of applying enough pressure to the conductor to displace the insulation yet be flexible enough so as not to damage the conductive portion of the insulated conductor.

What is needed and what is not provided by the prior art is a trifurcated beam type terminal which has provisions for isolating the deflection of one portion from the other. While this general configuration is available in the art, there does not seem to be one available, other than those that involve complex designs relating to relative stiffness, which electrically engages conductors without damaging them.

SUMMARY OF THE INVENTION

The foregoing problems of prior art terminals of this type have been overcome by a terminal of this invention, said terminal being made from flat metallic resilient stock and adapted to be received in an aperture of a plastic terminal block. Each terminal includes a base having a trifurcated portion extending from the base with a center common furcation forming a conductor-receiving slot with each of two side furcations. Free end portions of the center furcation and of each side furcation cooperate to form conductor entrances to the slots with portions thereof being deformed to slice through the conductor insulation and establish electrical contact therewith.

The terminal includes provisions for substantially isolating the deflection of one side furcation from the other so that the insertion of a conductor into one slot does not significantly prestress the other side furcation, and possibly cause damage to a conductor which is inserted into the other slot. This is accomplished by providing the center furcation with a protrusion which is received in a recess of the terminal-receiving aperture of the block in which the terminal is mounted. This arrangement results in the lock-in of the center furcation in the block and substantially prevents its deflection when a conductor is received in one of the slots. This effectively causes the portions of the terminal to experience deflections which are independent of each other.

The terminal also includes a shoulder portion which is connected to the base through a necked-down portion. As the terminal is seated within an aperture in the block, plastic portions deform as the shoulder is moved therepast, and then, because of their elastic properties, snap back into their original positions about the neck to secure the terminal in the block. A wire-wrapping tang extends from the shoulder portion and below the block to receive convolutions of an end portion of another conductor.

BRIEF DESCRIPTION OF THE DRAWING

Other features of the present invention will be more readily understood from the following detailed description of specific embodiments thereof when read in conjunction with accompanying drawings in which.

DETAILED DESCRIPTION

Figure 1:
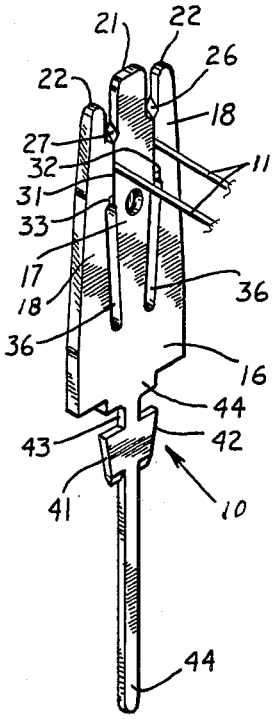
FIG. 1 is a perspective view of a terminal of this invention.
Figure 2:
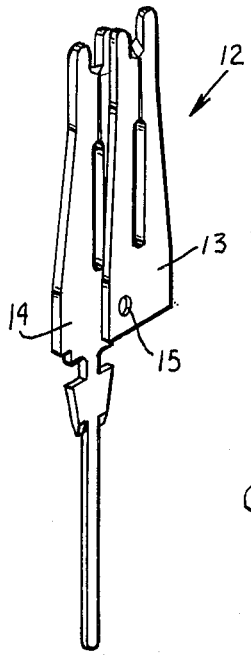
FIG. 2 is a perspective view of a prior art terminal.

Referring now to FIG. 1, there is shown a trifurcated terminal 10 for mechanically retaining and electrically engaging insulated conductors 11—11. The terminal 10 is made from a sheet of resilient, electrically conductive material such as, for example, Phosphor bronze having a thickness of about 0.1 cm and provides a conductor capacity at least equal to that of a prior art terminal 12 (see FIG. 2), that includes two overlapped terminals 13 and 14 which are welded together at a weld point 15. Each of the overlapped terminals 13 and 14 that are welded together may be of the design shown in hereinbefore mentioned U.S. Pat. No. 3,234,498 which is incorporated by reference hereinto.

Figure 3:
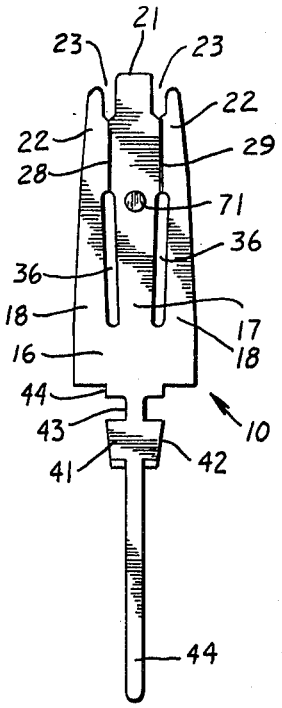
FIG. 3 is a front elevational view of the terminal of FIG. 1.

The terminal 10 includes a base 16 from which extends a center furcation or beam 17 (see also FIG. 3) and two lateral furcations or beams 18—18, one being disposed on each side of the center beam. The beams 17 and 18—18 are cantilevered out from the base 16 with which they are integral and have free end portions 21 and 22—22 respectively. In a preferred embodiment, the base has a width of about 1 cm and a height of about 0.47 cm while the furcations have a height of about 2 cm.

The free end portion 21 of the center beam 17 cooperates with the free end portion 22 of each of the lateral beams 18—18 to form a conductor-receiving entry 23. The conductor-receiving entry 23 is somewhat larger than the diameter-over-dielectric measurement of the largest gauge size conductor which is expected to be connected by the terminal 10.

In order to establish electrical engagement with the conductive portions of conductors 11—11, portions of the entry 23 are specially formed. An inner portion of the free end portion 21 and of the free end portion 22 are flattened to form coacting knife edges 26 and 27 which slice through the insulation of an insulated conductor that is moved through the entry 23.

After the initial movement into a terminal entry 23, the insulated conductor 11 must be mechanically retained within the terminal 10. This is accomplished by having opposing walls 28 and 29 of the center and lateral beams 17 and 18—18, respectively, form conductor-receiving slots 31—31. The width of each slot 31 determines the forces exerted by the beams or jaws or arms as they are also called against a conductor 11 when it is moved therebetween. In a preferred embodiment, the slots 31—31 are substantially parallel.

The width of each slot 31 is controlled by initially slitting metallic stock and then coining the walls 28 and 29 which define the slot 31 at their inner portions 32 and 33 to plastically deform these edges. See U.S. Pat. No. 3,234,498 which is incorporated by reference hereinto. This causes the opposing walls 28 and 29 of each slot to be spaced apart a predetermined distance. The profile of the gap or slot between the walls 28 and 29 is somewhat critical—it must be less than the diameter of the conductive part of the insulated condutor 11, but must be sufficiently large to permit plating of the inner edges of the beams 17 and 18. For a 24 gauge size insulated conductor, the gap between opposing surfaces of the beams 17 and 18 may be on the order of 0.013 cm.

The deflection characteristics of the beams 18—18 upon insertion of the insulated conductors 11—11 are further determined by the provision of elongated openings 36—36. These openings 36—36 which extend from the coined portions of the opposing walls 28 and 29 to the base 16 are formed by a removal of adjacent portions of the beams 17 and 18—18. Also, and as can best be seen in FIG. 2, the openings 36—36 are formed so that they are inclined to the longitudinal axis of the terminal 10.

The center beam 17 is formed to have a substantially uniform width along the length of the slot 31 (see again FIG. 3) and a decreasing width from the inner ends of the slots 31—31 to the base. On the other hand, each of the lateral beams 18—18 has an increasing width from the vicinity of the slots 31—31 to the base 16. As a result of this geometry, the effective width of each of the beams 17 and 18—18 adjacent to the base 16 is substantially the same.

Figure 4:
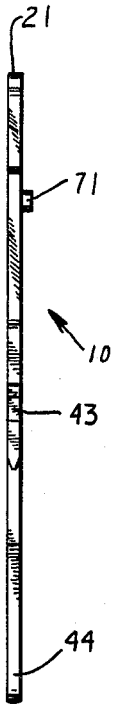
FIG. 4 is a side elevational view of the terminal in FIG. 1.

Each terminal 10 is constructed to include a shoulder 41 having sloping sides 42—42 which is joined to the base 16 through a stepped portion 44 and a necked-down portion 43. Conductors 11—11 which are inserted into the slots 31—31 are connected electrically to other conductors by providing facilities for attaching the other conductors to the terminal 10. This is accomplished by making the terminal 10 to include a wire-wrapping tang 44 that depends from the shoulder 41 (see also FIG. 4).

Figure 5:
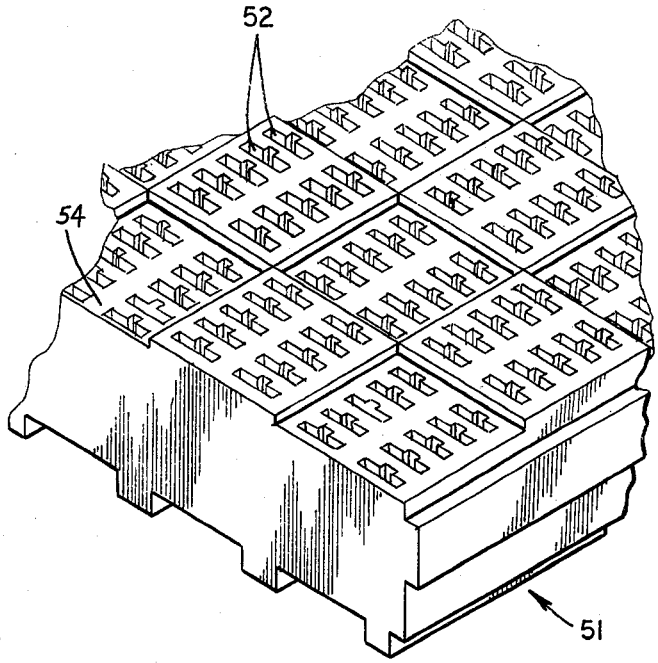
FIG. 5 is a perspective view of a terminal block having a plurality of apertures in which terminals of this invention are mounted.

A mass of the terminals 10—10 are assembled to a carrier or supporting block 51 (see FIG. 5) which is referred to as a terminal block and which is made of a plastic material such as, for example, polycarbonate. The block 51 includes a plurality of columns and of rows of terminal receiving apertures 52—52.

Each of the apertures 52—52 (see FIG. 6) includes a generally rectangular portion 53 which opens to a top surface 54 of the block. The dimensions of each rectangular portion are such as to receive the portion of the terminal between the coined portions and the base 16 and the necked down portion 43. For ease of assembly, the thickness of each aperture 52 is slightly greater than that of the terminal 10.

Figure 6:
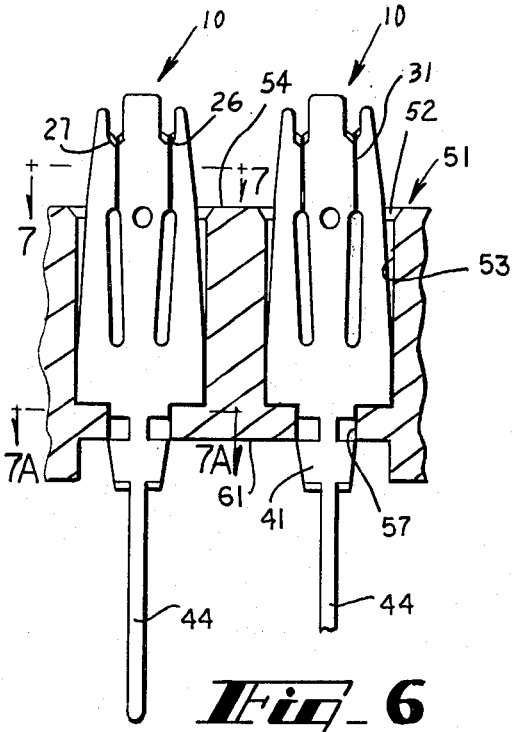
FIG. 6 is a cross-section view of a portion of the terminal block of FIG. 5 with terminals of this invention mounted therein.
Figure 7:
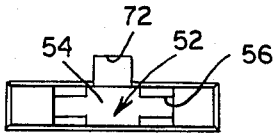
FIGS. 7 and 7A are plan views of an aperture of the block for receiving a terminal and taken along lines 7—7 and 7A—7A of FIG. 6 without the terminal being mounted therein.
Figure 7A:
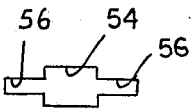

Viewing now a cross-section of each aperture 52 as in FIGS. 6 and 7 it is seen that the rectangular portion 53 communicates with a variable chamber 57 having a center section 54 of the same thickness and the same width as the necked-down portion 43 of the terminal 10 but with two oppositely extending portions 56—56 (see also FIG. 7A) having a reduced thickness. The reduced thickness of the oppositely extending portions 56—56 is less than that of the terminal 10 so that it forms an interference fit with the terminal as it is inserted within the block 51.

The variable cross-section chamber 57 of the aperture 52 communicates with a surface 61 of the underside of the block 51. In order to lock in the terminal 10 when it is seated in the block 51, the distance between the bottom of the rectangular chamber 53 and the surface 61 is slightly greater than the combined height of the necked-down portion 43 and the stepped portion 44.

In a two slot conductor terminal 10 having a common center arm 17, both side or lateral beams 18—18 react against the insertion of a conductor 11. For example, if a conductor 11 is inserted into one slot 31, each of the beams 17 and 18 must move a distance to allow entry of the conductor. The insertion of a conductor 11 into the other slot ordinarily requires considerably more force than required for the insertion of the first because the center beam 17 and the other lateral beam 18 are already stressed due to their deformation. The force required for insertion of the second conductor might be so great as to pinch off the conductor.

Recognition of the problem of the possible encounter of greater forces with a common center beam terminal 10 than with a prior style single slot terminal requires a solution in order to prevent damage to the conductor. While the prior art, i.e. U.S. Pat. No. 3,604,071 proffers a solution by controlling the relative stiffness of center and lateral arms, there is a need for a more reliable way of realizing the manufacturing economy of a three beam terminal while avoiding damage to the conductors. Moreover, any solution must be one which preserves the density of the terminals that is achieved with the welded style (see FIG. 2) which was described hereinbefore. This density of the terminal field in a direction across the width of the terminal block 51 is a function of the width of the terminal 10 at its base 16.

The above-identified problems have been overcome by providing lateral stability for the center beam 17 of the terminal 10 in its seated, locked-in position in the plastic block 51. This is accomplished by forming the center beam 17 with a key 71 (see FIGS. 3-4) which projects laterally from the plane of the terminal 10 adjacent to the uppermost portion of the elongated openings 36—36. The provisions for lateral stability are completed by forming each compartment 53 of the block to include a recess 72 (see FIG. 7) for receiving the key 71 of a terminal 10 which is inserted into the compartment.

Figure 8:
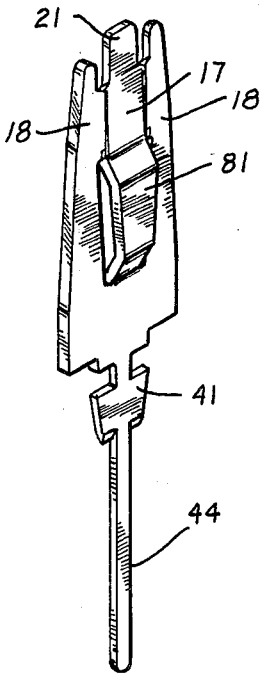
FIG. 8 is a perspective view of an alternate embodiment of this invention.
Figure 9:
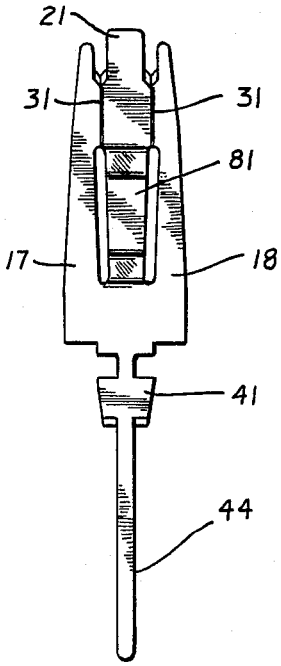
FIGS. 9 and 9A are front and side elevational views of the terminal of FIG. 8.
Figure 9A:
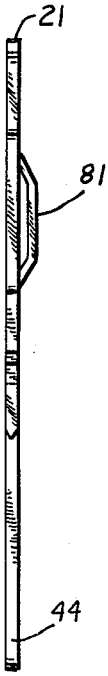

In a preferred embodiment, the key 71 takes the form of a cylindrical projection (see FIGS. 3-4) having a diameter of about 1.6 mm and a height of about 1 mm. However, it is to be understood that it could take other forms such as for example, a portion 81 of the center beam 18 between the coined areas and the base 16 being bowed out of the plane of the remainder of the terminal (see FIGS. 8 and 9-9A).

The above described arrangement substantially prevents movement of the center beam 17 in the plane of the terminal 10. This effectively isolates the deflection of one side furcation from the other so that the insertion of one conductor into one slot 31 does not significantly prestress the other side furcation. As a result, damage to a conductor that is inserted into the other slot is avoided.

The terminal 10 may be made to include additional features such as one for example which facilitates the movement of conductors 11—11 into the slots 31—31. The terminal 10 may be formed with a second projecting key (not shown) above the first one 71 or 81 and substantially adjacent the entries 23-33 to the slots 31—31. A tool (not shown) which is used to insert the conductors includes a recess for receiving the second projecting key to thereby maintain the two conductors, which are to be moved into the slots 31—31, spaced apart and to insure their alignment with the correct slots.

It is important to recognize that the tool which is used to insert conductors 11—11 into the slots 31—31 of a terminal 10 of this invention does not restrict the deflection of the lateral beams. Such restriction is unnecessary because of the stabilization of the center beam which substantially prevents prestressing the slot walls which define a slot opposite one which is already loaded.

It should be understood that the just described embodiments merely illustrate principles of the invention in selected, preferred forms. Many modifications, additions and deletions may, of course, be made thereto without departure from the spirit and scope of the invention as set forth in the following claims.

What is claimed is:

1. A terminal for electrical conductors, said terminal being made from an electrically conductive material and capable of being mounted in an aperture of a supporting block that is made of a dielectric material with portions of said terminal extending beyond a surface of the block to which the aperture opens to permit the connection of conductors, said terminal comprising:

a generally planar base portion; and a trifurcated portion which is connected to said base portion, said trifurcated portion being generally coplanar and unitary with said base portion and comprising;

a center furcation including a projecting key adapted to be received in a recess of an aperture of the supporting block in which said terminal is mounted; and a lateral furcation which is disposed adjacent to each side of said center furcation with adjacent portions of each lateral furcation and said center furcation forming therebetween a conductor-receiving slot and an elongated associated opening that communicates with an inner end of the associated conductor-receiving slot and that extends substantially to said base portion, said projecting key of said center furcation being formed substantially along a line which is transverse of a longitudinal axis of said terminal and which extends through the intersections of said conductor-receiving slots and said elongated openings and being adapted to cooperate with a portion of the supporting block which defines said recess substantially to prevent movement of said center furcation toward one of the lateral furcations when a conductor is inserted into the slot which is defined by the center furcation and the other lateral furcation.

2. The terminal of claim 1, wherein said elongated openings are inclined toward each other, said openings being closer adjacent to said base portion than adjacent to said conductor-receiving slots.

3. The terminal of claim 1, wherein the effective widths of said center furcation and said lateral furcations along a line adjacent to said base portion are essentially equal.

4. The terminal of claim 1, wherein said terminal is made from a flat strip of resilient metallic material and wherein said key projects from the plane of the terminal, said key having a cylindrical cross-sectional shape.

5. The terminal of claim 1, wherein said terminal is made from a flat strip of resilient metallic material and wherein said key includes a portion of said center furcation which is adjacent to said elongated openings and which has been deflected out of the plane of the terminal.

6. The terminal of claim 1, wherein said conductor-receiving slots are substantially parallel.

7. A terminal block for establishing electrical connections with electrical conductors, said terminal block comprising:

a supporting block which is made of a plastic material and which has a plurality of terminal-receiving, generally rectangularly shaped apertures that are arranged in a predetermined geometrical pattern and which open to a surface of the block, each of said apertures including a recess which extends in a direction laterally of the width of said aperture and which communicates with said surface of said block; and a plurality of terminals, each being made from a strip of electrically conducting resilient metal, being mounted in one of said apertures of said block, and comprising:

a generally planar base portion having a width which is less than the width of the aperture in the supporting block in which said terminal is mounted; and a trifurcated portion which extends from said base portion across its width, said trifurated portion being generally coplanar and unitary with said base portion and comprising:

a center furcation having a free end portion at an end opposite to said base portion, said center furcation including a projecting key adapted to be received in the recess of the aperture in which said terminal is mounted; and a lateral furcation disposed on each side of said center furcation with adjacent portions of each said lateral furcation and said center furcation forming therebetween a conductor-receiving slot and an elongated associated opening that communicates with an inner end of the associated conductor-receiving slot and that extends substantially to said base portion, said lateral furcations having free end portions which are disposed adjacent to said free end portion of said center furcation to provide entrance portions to said conductor-receiving slots, said projecting key of said center furcation being formed substantially along a line which is transverse of a longitudinal axis of said terminal and which extends through the intersections of said conductor-receiving slots and said associated elongated openings and cooperating with portions of said supporting block which defines said recess of the aperture in which said terminal is mounted to prevent substantially movement of said center furcation in a direction along the width of said base portion and to allow substantial portions of said conductor-receiving slots to extend beyond a surface of said terminal block while anchoring said key of said center furcation when a conductor is inserted into one of said slots; and means connected to said base portion for mounting said terminals within said supporting block with said entrance portions and at least portions of said conductor-receiving slots of said terminal being exposed beyond the surface of the block to which the apertures open to permit the movement of insulated conductors into said slots.

8. The connector of claim 7, wherein said conductor-receiving slots of each said terminal are substantially parallel.

9. The connector of claim 7, wherein said elongated openings between each of said lateral furcations and said center furcation are inclined toward each other, said openings being closer adjacent said base portion than adjacent to said slots.

10. The connector of claim 7, wherein the effective widths of said center furcation and each said lateral furcation of each said terminal are essentially equal.

11. The terminal block of claim 7, wherein said projecting key of each said terminal has a cylindrical cross-sectional shape.

12. The terminal block of claim 11, wherein said terminals are mounted in said block so that at least a portion of said projecting key of each said terminal is generally intersected by a plane of the surface of the block to which said apertures open.

* * * * *